US011644855B2

(12) United States Patent
Lin et al.

(10) Patent No.: US 11,644,855 B2
(45) Date of Patent: May 9, 2023

(54) VOLTAGE REGULATOR

(71) Applicant: HANGZHOU VANGO TECHNOLOGIES, INC., Hangzhou (CN)

(72) Inventors: Ling Lin, Hangzhou (CN); Nick Nianxiong Tan, Hangzhou (CN); Xiangyang Jiang, Hangzhou (CN); Zhong Tang, Hangzhou (CN)

(73) Assignee: HANGZHOU VANGO TECHNOLOGIES, INC., Hangzhou (CN)

( * ) Notice: Subject to any disclaimer, the term of this patent is extended or adjusted under 35 U.S.C. 154(b) by 65 days.

(21) Appl. No.: 17/521,871

(22) Filed: Nov. 9, 2021

(65) Prior Publication Data

US 2022/0066493 A1 Mar. 3, 2022

(30) Foreign Application Priority Data

Sep. 11, 2020 (CN) ..... 202010954558.9

(51) Int. Cl.
*G05F 1/575* (2006.01)
*G05F 1/565* (2006.01)

(52) U.S. Cl.
CPC ..... *G05F 1/575* (2013.01); *G05F 1/565* (2013.01)

(58) Field of Classification Search
CPC ..... G05F 1/565; G05F 1/575
See application file for complete search history.

(56) References Cited

U.S. PATENT DOCUMENTS

| | | | | |
|---|---|---|---|---|
| 11,243,553 | B1 * | 2/2022 | Ilie | G05F 1/565 |
| 2009/0096433 | A1 * | 4/2009 | Gerber | G05F 1/56 323/270 |
| 2010/0052635 | A1 * | 3/2010 | Wang | G05F 1/575 323/280 |
| 2010/0213917 | A1 | 8/2010 | Pulijala et al. | |
| 2015/0198960 | A1 * | 7/2015 | Zhang | G05F 1/56 323/280 |
| 2017/0017250 | A1 * | 1/2017 | Peluso | G05F 1/575 |

FOREIGN PATENT DOCUMENTS

| | | |
|---|---|---|
| CN | 102364407 | 2/2012 |
| CN | 103543777 | 1/2014 |
| CN | 105549673 | 5/2016 |
| CN | 110632972 | 12/2019 |

* cited by examiner

*Primary Examiner* — Kyle J Moody
*Assistant Examiner* — Lakaisha Jackson
(74) *Attorney, Agent, or Firm* — JCIP Global Inc.

(57) ABSTRACT

Disclosed is a voltage regulator, which makes a low dropout regulator stop working by controlling a sampling circuit of the low dropout regulator to break in a sleep mode, and makes an output voltage of the low dropout regulator follow an output voltage of a first bias voltage generating circuit by using a first MOS transistor connected between an voltage input end and an voltage output end of the low dropout regulator in a source follower structure, and is capable of controlling an output voltage of the whole voltage regulator by a generated bias voltage applied to the first bias voltage generating circuit by a first bias current source.

7 Claims, 2 Drawing Sheets

VOLTAGE REGULATOR

CROSS-REFERENCE TO RELATED APPLICATION

This application claims the priority benefit of China application serial no. 202010954558.9, filed on Sep. 11, 2020. The entirety of the above-mentioned patent application is hereby incorporated by reference herein and made a part of this specification.

BACKGROUND

Technical Field

The present invention relates to the field of power supply technologies, and more particularly, to a voltage regulator.

Description of Related Art

At present, most meter solutions need to support 5 V power supply. To be compatible with a 3.3 V analog module, a 3.3 V output voltage regulator (LDO33) needs to be added in power management architecture of the chip. Even for a low power design, the module also needs power consumption of above 1 uA, which accounts for about 30% of static power consumption of the main chip. How to further reduce the power consumption of the LDO33 is a technical problem to be solved by those skilled in the art.

The LDO refers to a low dropout regulator, which is a low dropout regulator relative to a traditional linear voltage regulator. The low dropout regulator needs to be capable of providing a stable output under a maximum load in a normal working mode to ensure performances of the chip; while in a sleep mode, most functional modules powered by the LDO33 are switched off, and the LDO33 only needs to provide a lowest working voltage to keep always-on circuit working. For example, in the normal working mode, the LDO33 needs to provide a 3.3 V stable output under a maximum load of 30 mA; while in the sleep mode, the load of the LDO33 will not exceed 100 uA, and a required minimum output voltage may usually be 2.2 V.

The present LDO implementation manner needs to compare a sampling voltage with a reference so as to regulate the output and keep a stable output under different loads. A sampling mode is usually implemented by a series of divider resistances. To design a LDO with low power consumption, in addition to reducing power consumption of an error amplifier (EA) module, current in the sampling resistance branch also needs to be minimized, which can only be implemented by increasing resistance since a voltage at both ends of these resistors are fixed, and this means large area consumption of the resistor. To reduce the power consumption of the LDO33 to 0.1 uA, it is assumed that a traditional solution is used, the power consumption of the error amplifier is ignored first, the sampling resistance needs to be increased to 33 Mohm, which is excessively high in die size cost, and is not suitable for application.

SUMMARY

An objective of the present invention is to provide a voltage regulator, which can further reduce power consumption of a low dropout regulator without increasing resistance.

In order to solve the above technical problem, the present invention provides a voltage regulator, which includes a low dropout regulator, a first MOS transistor, a second MOS transistor, a first bias current source, a first bias voltage generating circuit, a switch inserted in a sampling circuit of the low dropout regulator, and a controller connected with a control end of the switch and configured to switch off the switch in a sleep mode.

A drain of the first MOS transistor and a positive end of the first bias current source are both connected with a voltage input end of the low dropout regulator, a source of the first MOS transistor is connected with a voltage output end of the low dropout regulator, a gate of the first MOS transistor, a negative end of the first bias current source, a drain of the second MOS transistor, and a gate of the second MOS transistor are connected, a source of the second MOS transistor is connected with a positive electrode of the first bias voltage generating circuit, and a negative electrode of the first bias voltage generating circuit is grounded.

Optionally, the low dropout regulator is specifically a low dropout regulator with an output of 3.3V.

Optionally, the first bias voltage generating circuit is specifically built by using NMOS transistors.

Optionally, the voltage regulator further includes a second bias current source, a second bias voltage generating circuit, and a voltage comparator.

A positive electrode of the second bias voltage generating circuit is connected with the voltage supply of the low dropout regulator, a negative electrode of the second bias voltage generating circuit is connected with a positive end of the second bias current source and a positive input of the voltage comparator, a negative end of the second bias current source is grounded, a negative input of the voltage comparator is connected with a reference voltage signal, an output of the voltage comparator is connected with a gate of a preset output MOS transistor, a source of the preset output MOS transistor is connected with the voltage supply of the low dropout regulator, and a drain of the preset output MOS transistor is connected with the voltage output end of the low dropout regulator.

Optionally, the preset output MOS transistor is specifically an output MOS transistor of the low dropout regulator.

Optionally, the second bias voltage generating circuit is specifically built by using a PMOS transistor.

Optionally, the voltage comparator is specifically a low-power consumption voltage comparator.

The voltage regulator provided by the present invention includes the low dropout regulator, the first MOS transistor, the second MOS transistor, the first bias current source, the first bias voltage generating circuit, the switch inserted in the sampling circuit of the low dropout regulator, and the controller connected with the control end of the switch and configured to switch off the switch in the sleep mode; wherein the drain of the first MOS transistor and the positive end of the first bias current source are both connected with the voltage supply of the low dropout regulator, the source of the first MOS transistor is connected with the voltage output end of the low dropout regulator, the gate of the first MOS transistor, the negative end of the first bias current source, the drain of the second MOS transistor, and the gate of the second MOS transistor are connected, the source of the second MOS transistor is connected with the positive electrode of the first bias voltage generating circuit, and the negative electrode of the first bias voltage generating circuit is grounded. The voltage regulator makes the low dropout regulator stop working by controlling the sampling circuit of the low dropout regulator to break in the sleep mode, and makes the output voltage of the low dropout regulator follow the output voltage of the first bias voltage generating circuit by using the first MOS transistor connected between the voltage supply and the voltage output end of the low dropout regulator in a source follower structure, and is capable of controlling the output voltage of the whole voltage regulator by a generated bias voltage applied to the first bias voltage generating circuit by the first bias current source. Therefore, the invention provides a solution of further reducing the power consumption of the low dropout regulator without increasing resistance, and compared with a mode of reducing the power consumption by increasing resistance value of sampling resistors, the first bias voltage generating circuit is capable of implementing a target output voltage with smaller circuit cost and space cost, which is suitable for practical application.

BRIEF DESCRIPTION OF THE DRAWINGS

In order to illustrate the technical solutions in the embodiments of the present invention or in the prior art more clearly, the drawings used in the description of the embodiments or the prior art will be briefly described below. Obviously, the drawings in the following description are merely some embodiments recorded in the present invention. For those of ordinary skills in the art, other drawings may also be obtained based on these drawings without going through any creative work.

DETAILED DESCRIPTION OF DISCLOSED EMBODIMENTS

The core of the present invention is to provide a voltage regulator, which can further reduce power consumption of a low dropout regulator without increasing resistance.

The following clearly and completely describes the technical solutions in the embodiments of the present invention with reference to the accompanying drawings in the embodiments of the disclosure. Apparently, the described embodiments are merely some but not all of the embodiments of the present invention. Based on the embodiments of the present invention, all other embodiments obtained by those of ordinary skills in the art without going through any creative work shall fall within the protection scope of the present invention.

Figure 1:
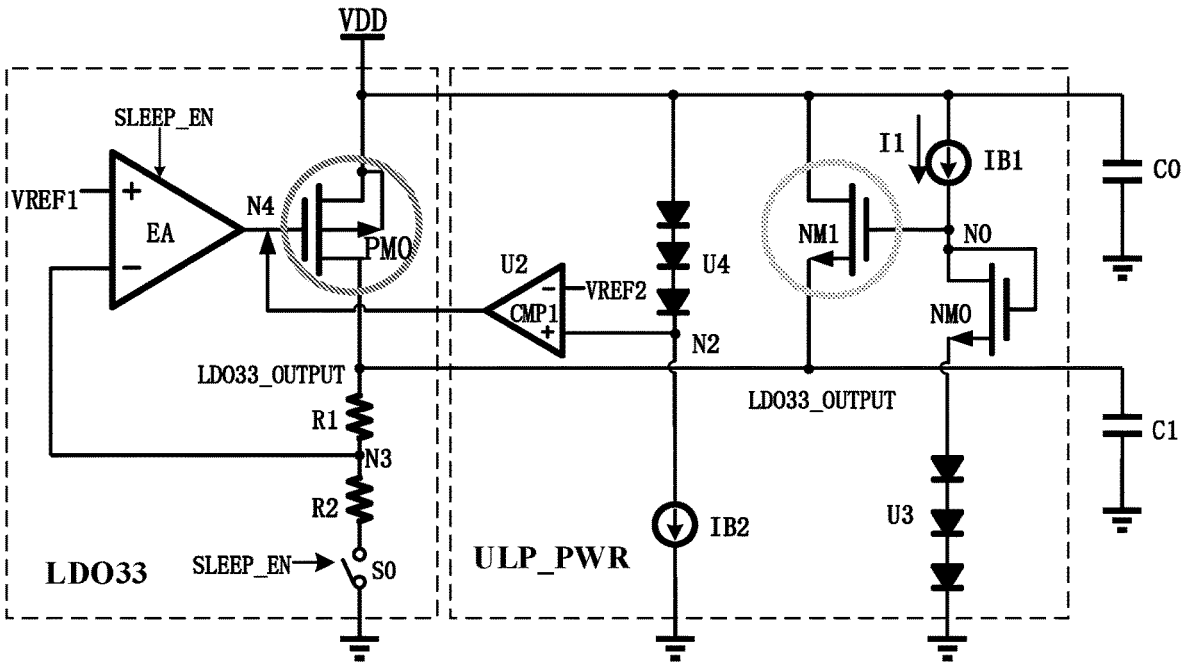
FIG. 1 is a circuit diagram of a voltage regulator provided by an embodiment of the present invention.

FIG. 1 is a circuit diagram of a voltage regulator provided by an embodiment of the present invention.

As shown in FIG. 1, a voltage regulator provided by the embodiment of the present invention includes a low dropout regulator, a first MOS transistor NM1, a second MOS transistor NM0, a first bias current source IB1, a first bias voltage generating circuit U3, a switch S0 inserted in a sampling circuit of the low dropout regulator, and a controller connected with a control end of the switch S0 and configured to switch off S0 in a sleep mode.

A drain of the first MOS transistor NM1 and a positive end of the first bias current source IB1 are both connected with the voltage supply of the low dropout regulator, a source of the first MOS transistor NM1 is connected with a voltage output end of the low dropout regulator, a gate of the first MOS transistor NM1, a negative end of the first bias current source IB1, a drain of the second MOS transistor NM0, and a gate of the second MOS transistor NM0 are connected, a source of the second MOS transistor NM0 is connected with a positive electrode of the first bias voltage generating circuit U3, and a negative electrode of the first bias voltage generating circuit U3 is grounded.

It should be noted that in the embodiment of the present invention, a 3.3 V output low dropout regulator (LDO33 for short) with a typical structure is taken as an example for description, and low dropout regulators with other output values or structures may also be applied.

As shown in FIG. 1, a source of an output transistor PM0 of the LDO33 is a voltage supply end, which is connected with an input power source VDD. The VDD is also connected with a first end of a decoupling capacitor C0, and a second end of the decoupling capacitor C0 is grounded. A drain of the output transistor PM0 is a voltage output end LDO33_OUT, the voltage output end LDO33_OUT is connected with a first end of a decoupling capacitor C1, and a second end of the decoupling capacitor C1 is grounded. The LDO33_OUT passes through the decoupling capacitor and then is supplied to a load. Meanwhile, the drain of the output transistor PM0 is connected with a sampling circuit, and is composed of sampling resistors R1 and R2. A middle point N3 of the two sampling resistors is connected with a negative input end of an error comparator EA, a positive input end of the error comparator EA is connected with a reference voltage VREF1, and an output end N4 of the error comparator EA is connected with a gate of the output transistor PM0.

In the embodiment of the present invention, an ultra low power standby power source (ULP_PWR) is added based on the original low dropout regulator. In a sleep mode, an output control signal SLEEP_EN of the controller controls the switch S0 to switch off so as to make the LDO33 stop working, and an output of the ULP_PWR module replaces the low dropout regulator to supply power. The output control signal SLEEP_EN of the controller also controls the error comparator EA to switch off, which means that in the sleep mode, after the controller controls the switch S0 to switch off, the controller further controls the error comparator EA to switch off, so as to remove all consumption of the original LDO33. The first MOS transistor NM1 and the second MOS transistor NM0 are both NMOS transistors.

The ULP_PWR module employs a source follower structure, the source of the first MOS transistor NM1 is connected with the voltage output end of the LDO33, and an output is about a gate voltage $V_{N0}$ of the first MOS transistor NM1 subtracting a gate source voltage drop $V_{GS,\ NM1}$ of the first MOS transistor NM1, that is, $V_{LDO33_OUT}=V_{N0}-V_{GS,NM1}$.

The gate of the first MOS transistor NM1 is connected with the second MOS transistor NM0 and the first bias voltage generating circuit U3, then $V_{N0}=V_{U3}+V_{GS,NMO}$. If a threshold voltage of the first MOS transistor NM1 is close to a threshold voltage of the second MOS transistor $N_{M0}$ ($V_{GS,NM0}=V_{GS,NM1}$), the output of the ULP_PWR module is almost equal to a voltage at both ends of the first bias voltage generating circuit U3, that is, $V_{LDO33_OUT}=V_{U3}$. Therefore, if the $V_{LDO33_OUT}$ needs to be equal to 3.3 V, the first bias voltage generating circuit U3 needs to provide a voltage close to 3.3 V.

If the output voltage of voltage regulator is excessively high, the module supplied by LDO33 may deviate from a normal working point, which affects performance, and may even cause problems such as an overvoltage and a chip damage. However, through the structure of the ULP_PWR module provided by the embodiment of the present invention, when an input voltage is excessively high, a constant bias current I1 provided by the first bias current source IB1 clamps the Gate at (approximately) a fixed level (such as 3.3

V), so that the output is not excessively high. Moreover, compared with a solution of increasing a sampling resistance to reduce the power consumption, a target voltage drop may be implemented with a smaller bias current (usually about 10 nA or about 20 nA) by making the output voltage of the low dropout regulator follow the output voltage of the first bias voltage generating circuit, so that the overall power consumption may be very low, which is about 100 nA.

The first bias voltage generating circuit U3 may include a plurality of diodes connected in series. An anode of a diode at one end is the positive electrode of the first bias voltage generating circuit U3, and a cathode of another diode is the negative electrode of the first bias voltage generating circuit U3. Each diode may be implemented by diode-connected structure of NMOS transistors or PMOS transistors. To avoid breakdown of the transistor, the first bias voltage generating circuit U3 is preferably built with the NMOS, and a device having a small deviation with temperature and process should be selected as much as possible. Meanwhile, an overvoltage (between a gate and a well/substrate) and an influence on leakage current from the substrate should also be considered. In addition, since the deviations are superimposed, the number of transistors connected in series needs to be minimized while implementing a required voltage. If other types of low dropout regulators (different output voltage) need to be matched, a type and a number of the diodes in the first bias voltage generating circuit U3 may be regulated.

The voltage regulator provided by the embodiment of the present invention includes the low dropout regulator, the first MOS transistor, the second MOS transistor, the first bias current source, the first bias voltage generating circuit, the switch inserted in the sampling circuit of the low dropout regulator, and the controller connected with the control end of the switch and configured to switch off the switch in the sleep mode. The drain of the first MOS transistor and the positive end of the first bias current source are both connected with the voltage supply of the low dropout regulator, the source of the first MOS transistor is connected with the voltage output end of the low dropout regulator, the gate of the first MOS transistor, the negative end of the first bias current source, the drain of the second MOS transistor, and the gate of the second MOS transistor are connected, the source of the second MOS transistor is connected with the positive electrode of the first bias voltage generating circuit, and the negative electrode of the first bias voltage generating circuit is grounded. The voltage regulator makes the low dropout regulator stop working by breaking the sampling circuit controlling the low dropout regulator in the sleep mode and switching off the EA, and makes the output voltage of the low dropout regulator follow the output voltage of the first bias voltage generating circuit by using the first MOS transistor connected between the voltage input end and the voltage output end of the low dropout regulator in the source follower structure, and is capable of controlling the output voltage of the whole voltage regulator by a generated bias voltage applied to the first bias voltage generating circuit by the first bias current source. Therefore, the embodiment of the present invention provides a solution of further reducing the power consumption of the low dropout regulator without increasing resistance, and compared with a mode of reducing the power consumption by increasing resistance value of sampling resistors, the first bias voltage generating circuit is capable of implementing a target output voltage with smaller circuit cost and space cost, which is suitable for practical application.

Figure 2:
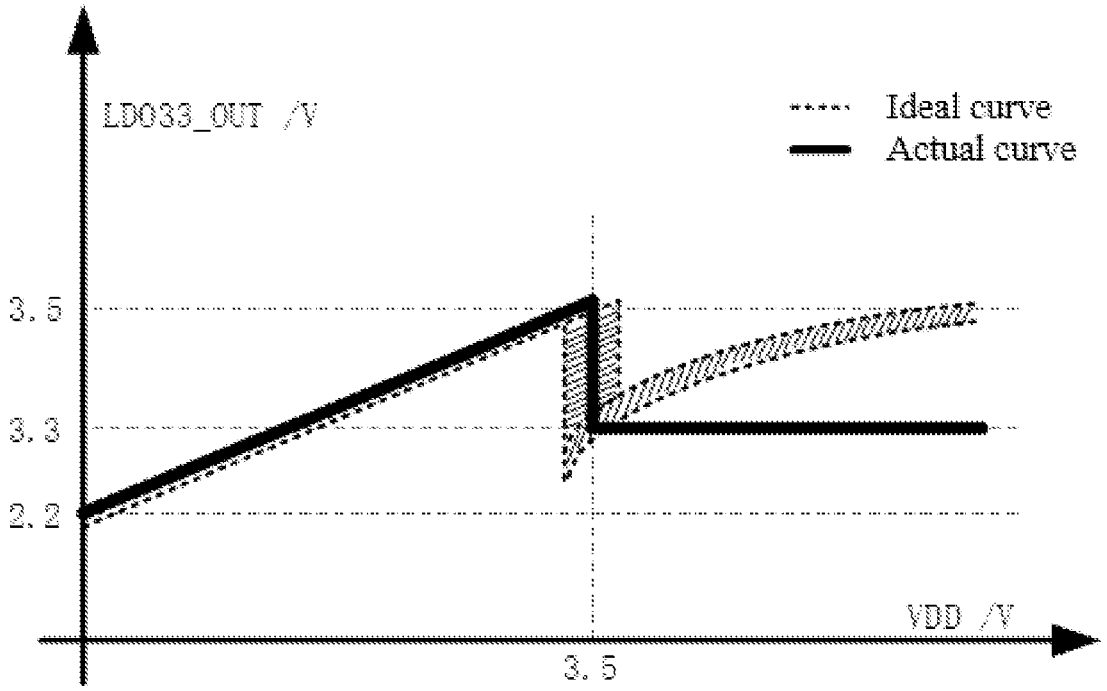
FIG. 2 is a simulation result diagram of the voltage regulator provided by the embodiment of the present invention.

FIG. 2 is a simulation result diagram of the voltage regulator provided by the embodiment of the present invention.

The voltage regulator provided in the above embodiment may clamp the Gate at (approximately) the fixed level by the constant bias current I1 provided by the first bias current source IB1 during high voltage input, so that the output is not excessively high. However, when the input voltage VDD is low, the MOS transistor acting as the first bias current source IB1 will work in a deep linear region, and a voltage drop at both ends of the MOS transistor is almost 0. At the moment, the first MOS transistor NM1 will follow the input voltage VDD, and the output $V_{LDO33_OUT}$ is equal to VDD-$V_{GS,\ NM1}$. Since most IoT (Internet of Things) chips need to support power supply by a battery or a super-capacitor, and a battery voltage may be gradually decreased due to discharge, a main control chip is required to have a large input voltage range, which means that the LDO33 needs to support wide voltage input. A lowest working voltage of the VDD may be as low as 2.2 V due to the discharge of the battery. At the moment, if one VGS (about 1.0 V) is subtracted from the output voltage, the power supply requirement of the LDO33 will not be met.

Therefore, on the basis of the above embodiment, to adapt to various power supply occasions, as shown in FIG. 1, the voltage regulator provided by the embodiment of the present invention further includes a second bias current source IB2, a second bias voltage generating circuit U4, and a voltage comparator U2.

A positive electrode of the second bias voltage generating circuit U4 is connected with the voltage input end VDD of the low dropout regulator, a negative electrode of the second bias voltage generating circuit U4 is connected with a positive end of the second bias current source IB2 and a positive input end of the voltage comparator U2, a negative electrode of the second bias current source IB2 is grounded, a negative electrode input end of the voltage comparator U2 is connected with a reference voltage signal, an output end of the voltage comparator U2 is connected with a gate of a preset output MOS transistor, a source of the preset output MOS transistor is connected with the voltage supply of the low dropout regulator, and a drain of the preset output MOS transistor is connected with the voltage output end of the low dropout regulator.

In specific implementation, the output MOS transistor used is the PMOS transistor. By adding the second bias current source IB2, the second bias voltage generating circuit U4 and the voltage comparator U2, the output $V_{LDO33_OUT}$ directly follows the VDD voltage when the input voltage VDD is low.

Similar to the first bias voltage generating circuit U3, the VDD voltage is dropped through a bias current applied to the second bias voltage generating circuit U4 by the second bias current source IB2 and then is compared with a reference voltage VREF2. The second bias voltage generating circuit U4 may include a plurality of diodes connected in series. An anode of a diode at one end is the positive electrode of the second bias voltage generating circuit U4, and a cathode of another diode is the negative electrode of the second bias voltage generating circuit U4. Each diode may be implemented by diode-connect structure of NMOS transistors or PMOS transistors. To avoid breakdown of the transistor, the second bias voltage generating circuit U4 is preferably built with the PMOS transistors, and a device having a small deviation with temperature and process should be selected as much as possible. Meanwhile, an overvoltage (between gate and well/substrate) and an influence on leakage current from the substrate should also be considered. In addition, since the deviations are superimposed, the number of transistors connected in series needs to be minimized while implementing a required voltage. When the second bias voltage generating circuit U4 is switched on, the target voltage drop may be implemented at a small current (usually about 10 nA or about 20 nA), and the overall power consumption may be very low, which is about 100 nA. If other types of low dropout regulators need to be matched or there are other output voltage requirements, a type and a number of the diodes in the second bias voltage generating circuit U4 may be regulated.

The voltage comparator U2 is a device for inputting two analog signals and outputting binary signals, and a low power consumption voltage comparator U2 is preferably used. A principle of the voltage comparator U2 is that: when a voltage at a positive input is higher than a voltage at a negative input, a high level 1 is outputted; and when the voltage at the positive input is lower than the voltage at the negative input, a low level 0 is outputted. When a voltage value obtained by subtracting a bias voltage on the second bias voltage generating circuit U4 from the VDD voltage (i.e., a voltage at a node N2) is higher than the reference voltage VREF2, the voltage comparator U2 outputs the high level 1 to cut off the output MOS transistor. When the voltage at the node N2 is lower than the reference voltage VREF2, the voltage comparator U2 outputs the low level to turn on the output MOS transistor.

In view of a fact that a lowest working voltage (output voltage) of the LDO33 is usually 2.2 V, and a voltage drop at the gate-source end of the first MOS transistor NM1 is about 1.0 V, to leave a margin at the same time, the second bias current source IB2 outputs the bias current I2 to make a voltage drop of the second bias voltage generating circuit U4 be 2.4 V, and a negative electrode input voltage VREF2 of the voltage comparator U2 is set to be 1.2 V. In this way, when the input voltage VDD is higher than 3.6 V, the voltage at the node N2 is higher than the VREF2, the voltage comparator U2 outputs the high level 1 to cut off the preset PMOS transistor, and a branch where the first MOS transistor NM1 is located will instead to output the voltage. When the input voltage VDD is lower than 3.6 V, the voltage at the node N2 will be lower than the VREF2, the voltage comparator U2 reversely outputs the low level 0, which controls the preset PMOS transistor to turn on, so that the output voltage $V_{LDO33_OUT}$ follows the input voltage VDD. Therefore, the output voltage can meet a power supply requirement for subsequent circuits in a wide input voltage range of 2.2 V to 5.5 V. The reference voltage VREF2 may be the same reference voltage as the reference voltage VREF1.

To further reduce the power consumption, a low power consumption voltage comparator U2 is employed as the voltage comparator U2.

Since the LDO33 already has an output transistor PM0 with a large driving capability, to reduce the cost, the output MOS transistor of the LDO33 may be employed as the preset output MOS transistor. The ULP_PWR module only needs to integrate one voltage comparator U2 and one second bias voltage generating circuit U4 on the basis of the output transistor PM0, and the connection method is as described above.

The diagram shown in FIG. 2 is obtained by performing simulation based on the voltage regulator provided by the embodiment of the present invention.

The output voltage LDO33_OUT of the LDO33 passes through the off-chip decoupling capacitor C1 to supply power to an analog circuit of the chip, the output voltage is 3.3V±10% during normal working, and an excessively high output voltage may cause a breakdown damage of some devices in the analog circuit. A POR/BOR circuit usually exists inside the chip, which is reset when the power supply which is LDO33_OUT is excessively low, so that the output of the LDO33_OUT cannot be lower than a reset voltage of the chip.

As shown in FIG. 2, there will be a turning point between two power supply mechanisms of the ULP_PWR module, which ensures that the output can be maintained between 2.0 V and 3.75 V within the full input range. It needs to be ensured that a lower threshold cannot trigger power-off reset, and it needs to be ensured that an upper threshold cannot exceed a maximum input voltage of the power supply module of the LDO33.

In practical application, the design may also be based on a low dropout regulator except the LDO33, a circuit connection structure may be described with reference to the embodiment of the present invention, and parameters of components are regulated as required, which all belong to the scope of protection of the present invention.

The voltage regulator provided by the present invention is described in detail above. The various embodiments in this specification are described in a progressive manner. Each embodiment focuses on the differences from the other embodiments, and the same or similar parts between the various embodiments may be referred to each other. It should be pointed out that for those of ordinary skills in the art, several improvements and modifications can be made to the present invention without departing from the principle of the present invention, and these improvements and modifications also fall within the protection scope of the claims of the present invention.

It should also be noted that relational terms in the specification such as first and second, etc., are used merely to distinguish one entity or operation from another entity or operation, and do not necessarily require or imply there is any such relationship or order between these entities or operations. Furthermore, the terms "including", "comprising" or any variations thereof are intended to embrace a non-exclusive inclusion, such that a process, a method, an article, or a device including a series of elements, includes not only those elements but also includes other elements not expressly listed, or also includes elements inherent to such process, method, article, or device. In the absence of further limitation, an element defined by the phrase "including a . . . " does not exclude the presence of the same element in the process, method, article, or device.

What is claimed is:

1. A voltage regulator, comprising a low dropout regulator, a first MOS transistor, a second MOS transistor, a first bias current source, a first bias voltage generating circuit, a switch inserted in a sampling circuit of the low dropout regulator, and a controller connected with a control end of the switch and configured to switch off the switch in a sleep mode;

wherein a drain of the first MOS transistor and a positive end of the first bias current source are both connected with a voltage input end of the low dropout regulator, a source of the first MOS transistor is connected with a voltage output end of the low dropout regulator, a gate of the first MOS transistor, a negative end of the first bias current source, a drain of the second MOS transistor, and a gate of the second MOS transistor are connected, a source of the second MOS transistor is connected with a positive electrode of the first bias voltage generating circuit, and a negative electrode of the first bias voltage generating circuit is grounded.

2. The voltage regulator according to claim 1, wherein the low dropout regulator is specifically a low dropout regulator with an output of 3.3 V.

3. The voltage regulator according to claim 1, wherein the first bias voltage generating circuit is specifically built by using an NMOS transistor.

4. The voltage regulator according to claim 1, further comprising a second bias current source, a second bias voltage generating circuit, and a voltage comparator;

wherein, a positive electrode of the second bias voltage generating circuit is connected with the voltage supply of the low dropout regulator, a negative electrode of the second bias voltage generating circuit is connected with a positive end of the second bias current source and a positive input end of the voltage comparator, a negative end of the second bias current source is grounded, a negative input end of the voltage comparator is connected with a reference voltage signal, an output end of the voltage comparator is connected with a gate of a preset output MOS transistor, a source of the preset output MOS transistor is connected with the voltage supply of the low dropout regulator, and a drain of the preset output MOS transistor is connected with the voltage output end of the low dropout regulator.

5. The voltage regulator according to claim 4, wherein the preset output MOS transistor is specifically an output MOS transistor of the low dropout regulator.

6. The voltage regulator according to claim 4, wherein the second bias voltage generating circuit is specifically built by using a PMOS transistor.

7. The voltage regulator according to claim 4, wherein the voltage comparator is specifically a low-power consumption voltage comparator.

* * * * *